United States Patent [19]

Drane

[11] Patent Number: 4,459,646

[45] Date of Patent: Jul. 10, 1984

[54] FLASHLIGHT CONSTRUCTION

[75] Inventor: John H. Drane, Kensington, England

[73] Assignee: Duracell Inc., Bethel, Conn.

[21] Appl. No.: 499,049

[22] Filed: May 27, 1983

[30] Foreign Application Priority Data

Jun. 29, 1982 [GB] United Kingdom ..... 8218803

[51] Int. Cl.[3] ..... F21L 7/00

[52] U.S. Cl. ..... 362/199; 200/60; 362/188; 362/200; 362/376

[58] Field of Search ..... 362/199, 188, 200, 376; 200/60

[56] References Cited

U.S. PATENT DOCUMENTS

| | | | |
|---|---|---|---|
| 1,701,093 | 2/1929 | Zook | 362/199 |
| 1,763,874 | 6/1930 | Zook | 362/199 |
| 1,763,898 | 6/1930 | Lorig | 362/199 |
| 1,792,547 | 2/1931 | Nygard | 362/199 |
| 1,857,390 | 5/1932 | Muldoon | 362/199 |
| 1,897,627 | 2/1933 | Zook | 362/199 |
| 1,926,108 | 9/1933 | Muldoon | 362/199 |
| 2,118,997 | 5/1938 | Zook | 362/199 |
| 2,494,886 | 1/1950 | Leif | 362/199 |

*Primary Examiner*—Stephen J. Lechert, Jr.

*Attorney, Agent, or Firm*—Ronald S. Cornell; Israel Nissenbaum

[57] ABSTRACT

A flashlight construction is disclosed, which comprises a body portion, a head portion attached to the body portion and pivotable about a single pivot axis, and through a pivot arc that lies in the longitudinal plane of the body portion, the body portion adapted to contain at least one battery and the head portion adapted to contain a light bulb. Separate electrical contact means are located in the body portion and the head portion and slidably engage with each other. The electrical contact means cooperates to define an electrical switch means that controls the flow of electrical current. The switch means is located inboard of the head portion and adjacent the pivot axis. Accordingly, the flashlight may be switched off by rotating the head portion into position in abuttment with the body portion, while switching the flashlight on as accomplished by rotating the head portion away from such abuttment. The head portion is adjustable to a plurality of positions along its pivot arc, and may remain fixed in any one of these positions, to permit adjustment in the direction of a beam of light emitted by the light bulb. The flashlight may be prepared from a variety of materials, such as plastics materials which are resilient and durable in use.

11 Claims, 6 Drawing Figures

FLASHLIGHT CONSTRUCTION

The present invention relates to flashlight constructions, and, in particular, to constructions suited for pocket-sized flashlights utilizing relatively low voltage battery cells.

Pocket-sized flashlights are well known and have been in existence for many years. Generally, pocket-sized flashlights utilize a cyclindrical or rectangular housing containing one or more batteries of the "A—A" size, and a fixed lamp head. Electrical contact is usually made by a slide switch located along the body or barrel of the flashlight, so that, for example, sliding the switch forward activates the flashlight.

Variant flashlight constructions generally offered as novelty items, have utilized a single battery cell, and a contact switch comprising a strip of metal resiliently disposed adjacent the flashlight head. In such instance, the flashlight bulb is shrouded by a pivoting cover, which cooperates with the resilient electrical contact, so that flipping the cover open, brings the electrical contact against the flashlight bulb, and completes the circuit to facilitate the operation of the flashlight.

Most of the flashlights of this size, however, are of a construction that renders their disassembly difficult. Thus, in the flashlight construction last described, the head portion containing the flashlight bulb, is snap-fittably engaged within the body retaining the battery cell, and must be pried loose with great physical exertion, to remove either the flashlight bulb or battery cell, for replacement or otherwise.

The standard flashlight construction generally utilizes a removable lens cover, that holds the flashlight bulb and its reflector in position; thus, unscrewing the lens cover permits the flashlight bulb and the batteries to drop out. In this construction, however, all of the pieces of the flashlight must be removed, when it is desired to change any particular element thereof.

Both of the aforementioned constructions are also of similar capability, as they are essentially monolithic in construction. That is, one must aim the entire body of the flashlight in a particular direction to cause a beam of light to pass in the desired direction. This could prove difficult in instances where one wishes to direct a beam of light toward a location that is physically inaccessible with the entire bulk of the flashlight body.

A need therefore exists for a flashlight that is of simple construction and operation, and that possesses the additional versatility of light beam control.

In accordance with the present invention a flashlight construction is prepared which comprises a body portion, a head portion attached to the body portion that is capable of pivoting through an arc about a single pivot axis, the arc lying in the longitudinal plane of the body portion. Separate electrical contact means are respectively, located in the body portion and the head portion, and slidably engagable with each other, and define between them electrical switch means to switch the flashlight on and off. The switch means is located inboard of the head portion and adjacent the pivot axis. Particular features of the flashlight include electrical switching means described above, and incremental adjustment means communicating with the pivot axis, that enables the head portion to reside in a plurality of positions along its pivot arc, so that a beam of light may be fixedly trained in a particular direction in use.

In the embodiment illustrated herein, a generally convex lens is removably mounted in the head portion, and a concavity is disposed in the body portion, and is positioned to nestingly receive the lens when the head portion is in abuttment with the body portion, and the flashlight is turned off. Also, the body portion is designed to permit simplified access to the battery compartment. In particular, the body portion has a central frame supporting a battery cradle, and paired, bilateral cover members removably attached to the frame. In the embodiment illustrated herein, the battery cradle is accessible from one side, so that one of the bilateral cover members may be easily pried away from the central frame, to access the batteries.

The internal location and design of the electrical switching means eliminates the need for operating the external slide switch well known and broadly used with flashlights. One need only rotate the head portion upward and away from abuttment with the body portion, much as one would operate a pocket cigarette lighter, to activate the flashlight, while at the same time positioning the light beam in the desired direction.

In this latter connection, the incremental adjustment means cooperating with the pivot axis, permits the light beam to be adjusted to one of several fixed positions, and will secure the light beam steadily in that position during use. Thus, the present flashlight permits the user to illuminate areas that are hard to reach with a conventional cumbersome flashlight.

The flashlight may be manufactured from a relatively small number of parts, and from generally inexpensive plastics materials. A particularly preferred plastic material is one which possesses resilience and durability for extended useful life, and includes the class of materials known as acetal resins.

Accordingly, it is a principal object of the present invention to provide a flashlight that is of simplified construction and use.

It is a further object of the present invention to prepare a flashlight construction useful in the manufacture of pocket-sized flashlights, that offers generally one piece construction, with an adjustable light beam direction.

It is a further object of the present invention to provide a flashlight construction as aforesaid that offers incremental light beam adjustment.

Other objects and advantages will become apparent to those skilled in the art from a review of the ensuing description which proceeds with reference to the following illustrative drawings.

Figure 1:
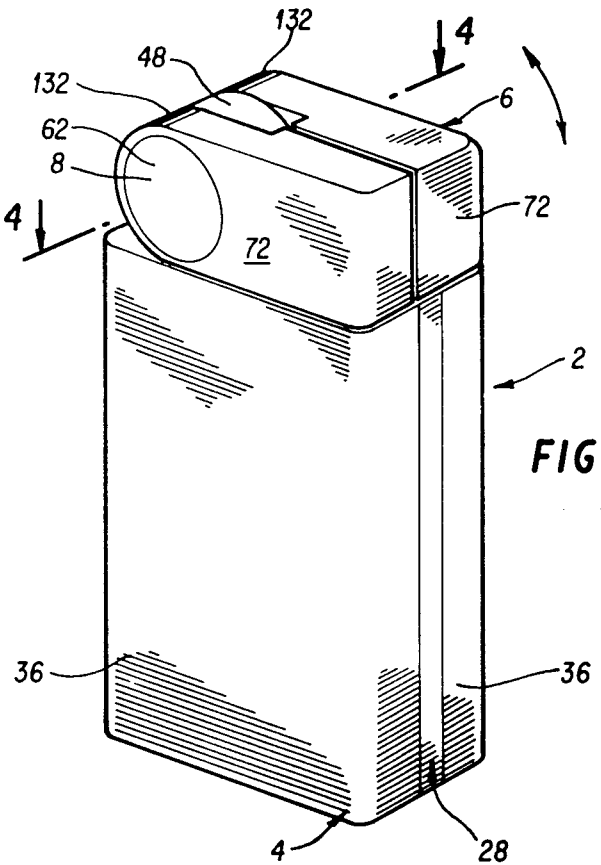
FIG. 1 is a perspective view of a flashlight in accordance with the present invention in the closed position.

Referring now to the drawings, FIG. 1 illustrates the flashlight 2 in the position it assumes when not in use. .Flashlight 2 comprises body portion 4 and head portion 6. Head portion 6 is pivotally attached to body portion 4 and is thus adapted to pivot about a single pivot axis 8, and through a pivot arc generally suggested by the double headed arrow. Pivot axis 8 is positioned essentially transverse to the longitudinal dimension of body portion 4, so that the pivot arc of head portion 6 lies in the longitudinal plane of body portion 4.

Figure 3:
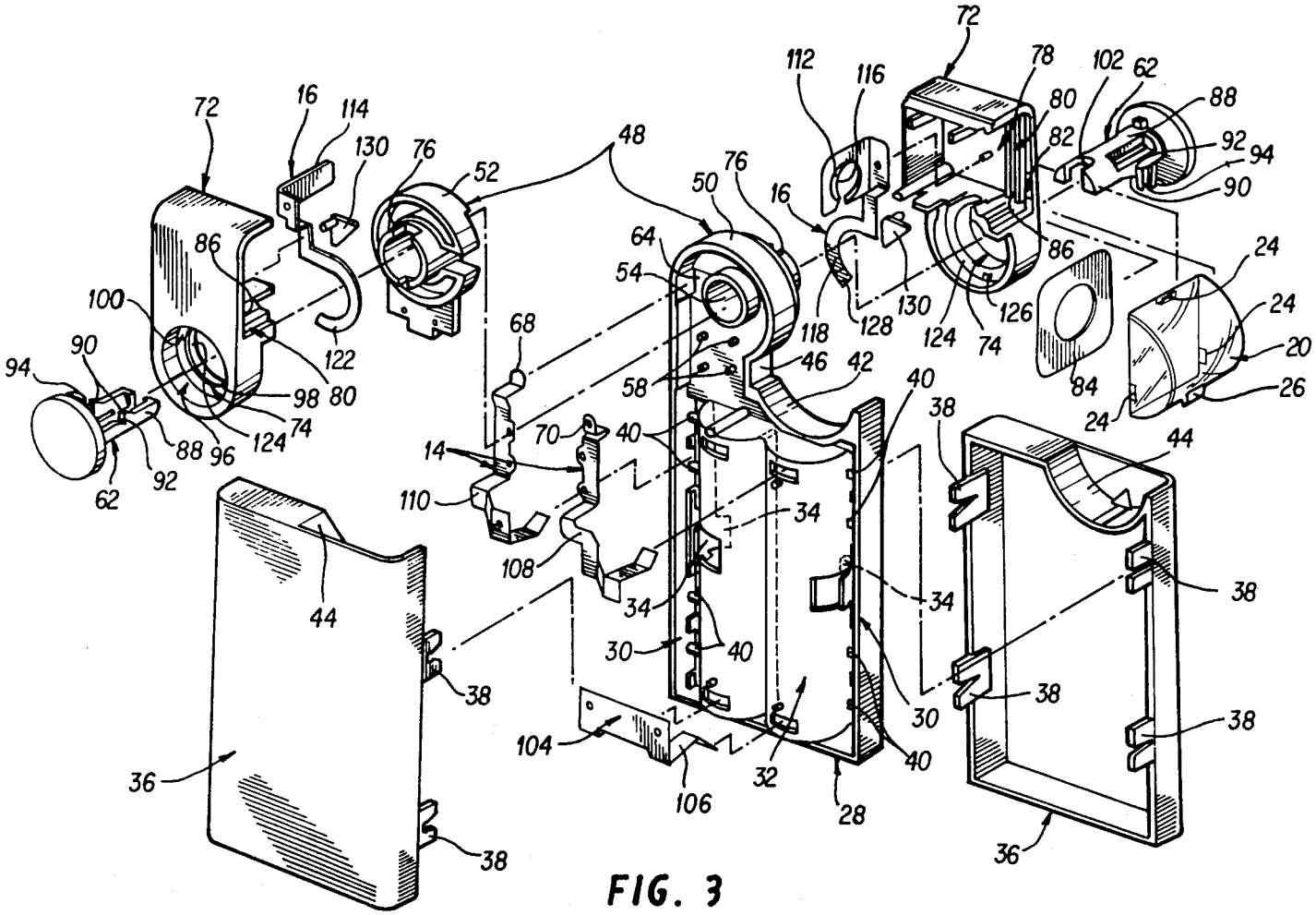
FIG. 3 is an exploded perspective view illustrating the various components of the flashlight of FIG. 1.
Figure 5:
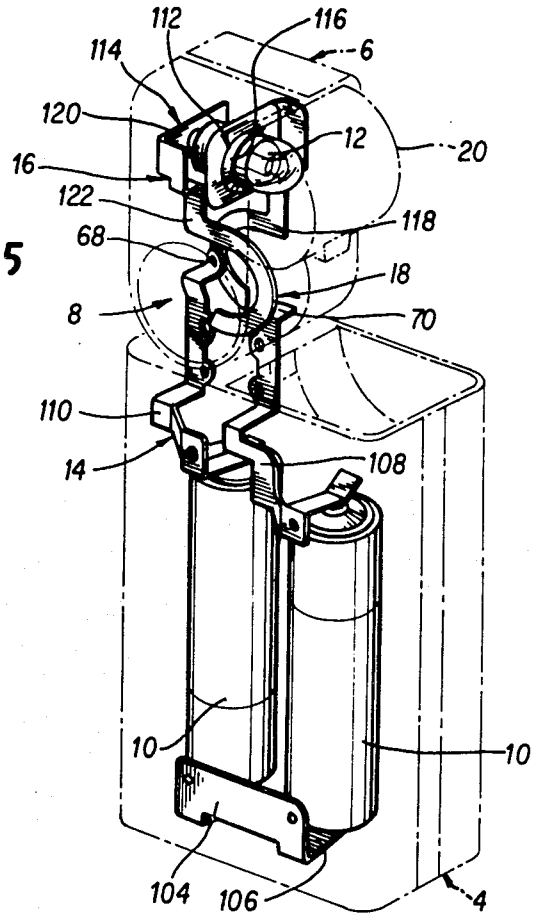
FIG. 5 is a perspective view, partly in phantom, illustrating the electrical contact means of the present invention.

As better shown in FIGS. 3 and 5, body portion 4 is adapted to contain one or more batteries labelled 10 in FIG. 5, and head portion 6 is adapted to house a light bulb, labelled 12 in FIG. 5.

Referring briefly to FIG. 5, separate electrical contact means are illustrated in operative position, and are respectively located in body portion 4 and head portion 6. Electrical contact means 14 is located within body portion 4, and makes electrical connection between batteries 10. Electrical contact means 16 located in head portion 6 provides both support and electrical connection for light bulb 12. Contact means 14 and 16 make slidable connection with each other in the area of pivot axis 8, and thereby define an electrical switch means, generally designated 18. The electrical contact means 14 and 16, and electrical switch means 18 will be discussed in further detail hereinafter.

Figure 2:
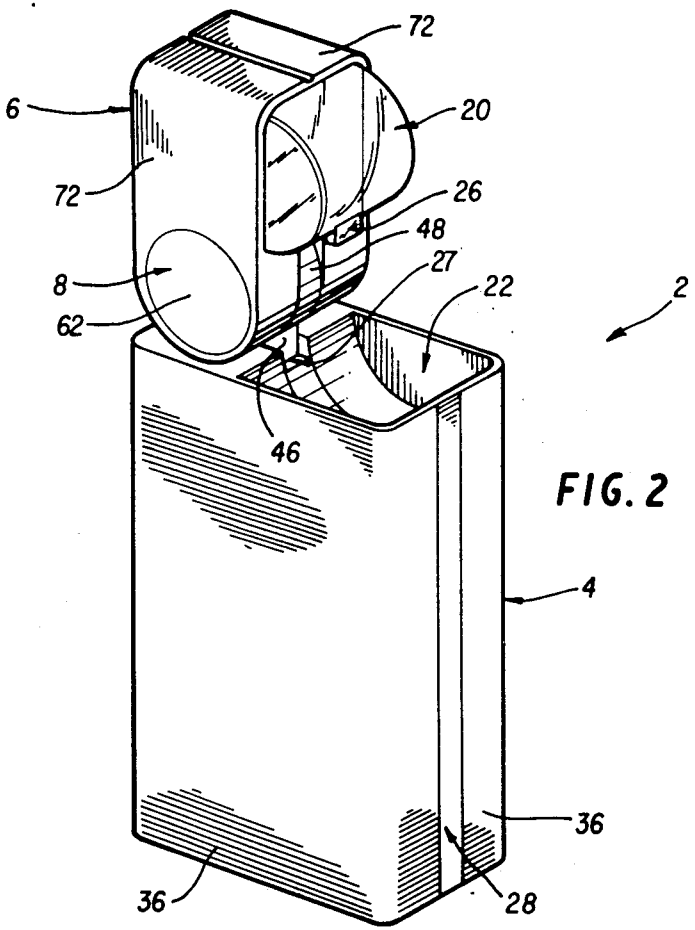
FIG. 2 is a perspective view illustrating the flashlight of FIG. 1 in the operating position.

Referring now to FIG. 2, one of the features of the present invention is that the activation and operation of flashlight 2 are accomplished by the rotation of head portion 6 from the closed position illustrated in FIG. 1, to an open position, such as that illustrated in FIG. 2. In the open position, head portion 6 is shown to include a lens 20 that shields the light bulb 12 and enhances the beam of light that is emitted therethrough. Lens 20 is illustrated as convex in shape, and in this illustration, body portion 4 defines an appropriate concavity 22 that can nestingly receive lens 20 when head portion 6 is in the position shown in FIG. 1. Referring momentarily to FIG. 3, lens 20 is adapted for snap-fittable, removable engagement with head portion 6. In particular, a plurality of ridges 24 are provided along the perimeter of lens 20, to engage corresponding grooves defined by head portion 6. Removal of lens 20 is facilitated by a tab 26, that may be grasped by the finger to pry lens 20 forward and away from head portion 6. In this manner, the lightbulb may be easily accessed for removal and replacement. Tab 26 is accommodated within concavity 22, by a central depression 27, so that flush abuttment is possible when head portion 6 is positioned as in FIG. 1.

Referring now to the FIGURES generally, and particularly with reference to FIG. 3, the body portion 4 of the present invention is composed of a plurality of parts. In particular, a central frame 28 defines the basic shape and perimeter of body portion 4 and provides the primary support for the batteries 10. In particular, frame 28 defines an essentially rectangular perimeter, the major longitudinal dimensions of which are defined by parallel spines 30. A battery cradle 32 is defined by frame 28, and is located between spines 30. Depending upon the number and configuration of the batteries utilized in the flashlight, the battery cradle 32 may assume the parallel trough shape shown in FIG. 3 or may, alternately, comprise a single trough, not shown herein. Battery cradle 32 includes resilient securing jaws 34, shown in phantom in FIG. 3, to provide resistance to disengagement of the batteries 10 placed therein.

Body portion 4 includes paired, bilateral cover members 36, that are adapted to snap-fittably mount upon frame 28. A plurality of disengagable latch means are defined between cover members 36 and spines 30. In particular, regularly spaced female catches 38 on cover members 36 are positioned to releaseably engage correspondingly aligned webs 40 located on spines 30. The positioning of the respective catches 38 on individual cover members 36 are staggered from each other, so that, when cover members 36 are brought together against frame 28, the respective catches 38 are disposed in space apart relation to each other, and make contact with separate webs 40. This means of attachment facilitates the easier removal of cover members 36, in the event that such is necessary. In particular, and with reference to FIG. 3, the cover member 36 shown in the right hand side of the drawing, is more frequently removed, as it comprises the direct cover for the batteries, inasmuch as cradle 32 opens in that direction, to permit batteries 10 to be removed.

Referring briefly to FIG. 2, the cooperation between cover members 36 and frame 28 is apparent. For example, the concavity 22 referred to earlier, is actually defined by the cooperation of a central arcuate depression 42 defined along the upper edge of frame 28, and mating lateral depression 44 defined by the corresponding portions of cover members 36. Additionally, an indentation 46 in frame 28, enables body portion 4 to receive tab 26, as described earlier.

Figure 4:
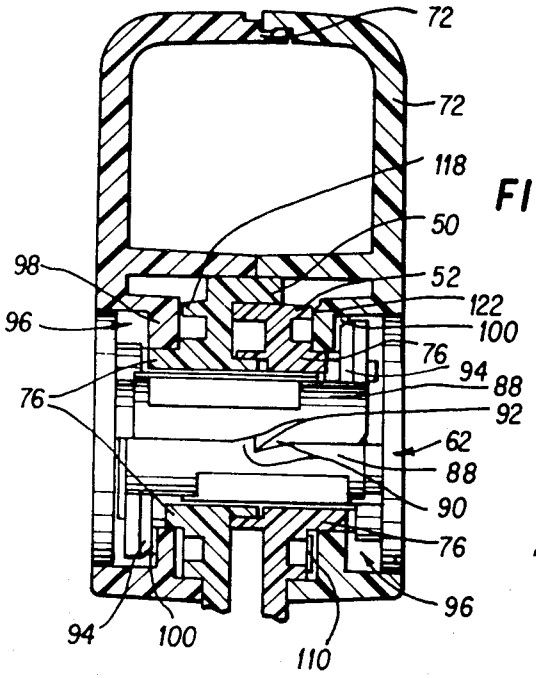
FIG. 4 is a fragmentary front sectional view taken through line 4—4 of FIG. 1, illustrating the cooperative assembly of the head portion and body portion in the area of the pivot axis.

Referring further to FIG. 3, frame 28 is adapted to pivotally receive head portion 6, by the provision of neck 48. Neck 48 comprises a primary axle housing 50 and a secondary axle housing 52 that is adapted to be telescopically received in lateral alignment with primary axle housing 50. Housings 50 and 52 each define cylindrical bores 54 and 56, respectively, which when aligned, provide a continuous cylindrical passageway for the pivot axis 8, described in detail hereinafter. Alignment between axle housings 52 and 54 in assured by the cooperation of projections 58 on axle housing 50, and mating pinholes 60 on axle housing 52. Referring briefly to FIG. 4, the coaction of axle housings 50 and 52 is shown in cross-section, lending primary support to the pivot axis 8, defined by identical axle stubs 62, which will be discussed later on herein.

Referring again to FIG. 3, axle housings 50 and 52 are provided with respective apertures to accommodate the portions of electrical contact means 14, that extend upward to define a component of electrical switch means 18. In particular, opening 64 is provided in primary housing 50 to receive the extending cursor 68 that operates the switch means 18 in a manner described later on herein. Correspondingly, opening 66 receives contact point 70 that provides continuous electrical connection between contact means 14 and contact means 16.

Referring again to FIGS. 1–3, head portion 6 comprises a shroud for light bulb 12 and corresponding electrical contact means 16, which is defined by bilaterally complementary half bonnets 72. At one end thereof, half bonnets 72 each define circular bearings 74 that telescopically receive the lateral extensions 76 of axle housings 50 and 52, as shown in FIG. 4. Thus, when assembled, half bonnets 72 rest on extensions 76 and rotate thereabout when head portion 6 pivots. At their other end, half-bonnets 72 cooperate to define a cavity for the reception of the light bulb 10, and the light bulb support assembly, the latter defined by electrical contact means 16. A window 78 is defined adjacent the cavity, and a window frame 80 includes appropriate depressions such as 82 to receive the ridges 24 of lens 20. Also, in the embodiment illustrated in FIG. 3, the light bulb support assembly includes a planar reflector 84, and frame 80 is provided with a casing 86 to retain the peripheral edges of reflector 84 when head portion 6 is fully assembled.

The pivot axis 8, about which head portion 6 rotates, is secured by paired axle stubs 62. Axle stubs 62 are identical in construction, and are adapted to permanently engage, as best shown in FIG. 4, by corresponding, hemi-cylindrical extensions 88 that define, along their lateral straight edges, mutual locking projections 90 and corresponding indentations 92. Stubs 62 are locked against each other, as shown in FIG. 4, by thrusting them toward each other within bores 54 and 56, until projections 90 pass each other and enter the corresponding indentations 92 located therebeyond. Assembly of this portion of the flashlight is thus simple and secure.

As noted earlier, an incremental adjustment means is provided adjacent to pivot axis, to permit head portion 6 to remain in a plurality of fixed positions in use. The incremental adjustment means comprises radially projecting resilient cleats 94, provided on individual strips extending from respective cylindrical extensions 88 of each axle 62. Half bonnets 72 define circular cavities 96 that are primarily provided to accommodate the lateral end of axle 62, so that, as shown in FIG. 4, the outer surfaces of stubs 62 are flush with the outer surfaces of bonnet 72. The inner end walls 98 of cavities 96 define a plurality of regularly spaced radially extending grooves 100 that releasably receive the leading edges of corresponding cleats 94, as shown in FIG. 4. Thus, when head portion 6 is opened to a particular position, as shown in FIGS. 2 and 5, cleats 94 make contact with one of grooves 100, so that head portion 6 can remain stable in the particular opened position selected. As axle stubs 62 are identical to each other, the corresponding half bonnets 72 that receive individual axle stubs, are provided with grooves 100 through an arc of approximately 180°, such that the arc of mating half bonnets 72 are complementary with each other.

Referring to FIG. 4, it can be seen that the cleat 94 disposed on the left hand side of the FIGURE extends downwardly, while the cleat 94 on the right hand side extends in the opposite direction. Thus, the grooves 100 provided to communicate with respective cleats 94, must be appropriately located, as explained.

An additional feature of axle stubs 62, is that the semi-cylindrical extensions 88 extend to surround the cleats 94 of the juxtaposed axle stub, as seen in FIG. 4. To accommodate the extension of cleat 94, each forward most end of the semi-cylindrical extensions 88, is provided with an appropriately dimensioned slot 102 to accommodate the cleat 94 in full assembly. In this way, the remainder of the extension 88 provides additional support to the cleat 94, to assure its continued durability in use.

An important feature of the present invention, comprises the electrical contact means and electrical switch means, both described partially, earlier herein. In particular, the electrical switch means 18 permits the present flashlight to be turned on and off by an internal mechanism that does not require independent manipulation. That is, one can merely move the head portion 6 out of the position shown in FIG. 1, into a position such as that illustrated in FIG. 2, whereupon the flashlight 2 will immediately commence operation.

Referring again to the drawings, and particularly to FIGS. 3 and 5, electrical contact means 16, disposed within body portion 4, provide connection between the batteries 10 and the remainder of the electrical circuit. Thus, contact means 14 comprises a basal battery connector 104 which, as indicated in FIG. 3, extends into electrical contact with batteries 10, by projections 106 that extend through openings provided in battery cradle 32. In the instance where a single battery cell, not illustrated herein, is utilized, basal battery connector 104 would probably extend upward to make contact with front upper battery connector 108, illustrated separately herein.

Front upper battery connector 108 extends from battery 10 upward in the direction of pivot axis 8, to provide a slidable contact with electrical contact means 16. In particular, the upper terminal end of connector 108 comprises contact point 70, that, as described earlier, extends through opening 66. Rear upper battery connector 110, in similar fashion, extends upper and terminates in cursor 68, that makes breakable contact with a corresponding portion of contact means 16, as described hereinafter. The electrical switching means 18 of the present invention, in essence comprises cursor 68 and the corresponding portion of contact means 16 with which it cooperates.

Electrical contact means 16 comprises frontal electrical contact 112 and rear electrical contact 114. Front electrical contact 112 is mounted within the cavity defined by half bonnets 72, and provides a central helical opening 116, to screw threadedly accept light bulb 12, as shown in FIG. 5. The remainder of front electrical contact 112 extends downward and then forms a rearward extending semi-circular track 118. Track 118 makes sliding contact with the leading edge of cursor 68, and is positioned so that, when head portion 6 is located in abuttment with body portion 4, track 118 and cursor 68 do not contact each other.

Rear electrical contact 114 comprises an end plate 120 that makes electrical contact with the rear of bulb 12, and a forwardly extending semi-circular track 122 that is positioned to be in constant slidable contact with contact point 70 of front upper battery connector 108. Thus, regardless of the position in which head portion 6 is located, direct contact exists between contact points 70 and track 122.

Switch means 18 is thus designed to reside inboard of head portion 6 and to locate in annular relation to pivot axis 8.

In particular, both tracks 118 and 122 are configured to reside against the inner surfaces or inside lateral walls of bearings 74. Thus, walls 124 give support to tracks 118 and 122 respectively, to assure that consistent electrical contact will be maintained when desired.

A further feature of the above construction is shown in FIG. 3, and relates to the improved durability of switch means 18. In particular, the inside wall 124 that receives and supports track 118, includes a combined terminal land and incline 126 that meets with the forward most tip 128 of track 118. Combined land and incline 126, thus serves as a final resting place for cursor 68, in the instance where head portion 6 has been pivoted into the closed or shut off position. This benefits the durability of switch means 18, as the possibility of abrasion to the surface of cursor 68 as it resumes position on track 118 is minimized or eliminated. The relatively resilient material out of which land and incline 126 is prepared, reduces the frictional wear on the point of cursor 68, as it deflects to resume position on track 118.

Referring further to FIG. 3, certain additional features of the present construction should be noted. In particular, half bonnets 72 provide a plurality of positioning pegs to align the respective components, such as the electrical contacts there within, for permanent installation. In this connection, triangular retainers 130 hold respective front and rear electrical contacts in position within half bonnets 72. Likewise, front and rear upper battery connectors 108 and 110, respectively, are provided with appropriate openings to rest on projections 58, to secure them in position between axle housing 50 and axle housing 52 in full assembly.

Referring again to the FIGURES, and particularly to FIGS. 3 and 5, the operation of switch means 18 is accomplished by the rotation of head portion 6 in relation to head portion 4. In particular, and as can be visualized in FIG. 5, when head portion 6 is displaced from its abuttment with body portion 4, cursor 68 is in contact with track 118. As head 6 is rotated forward and into abuttment with body portion 4, cursor 68 travels along track 118, and is so positioned that, when full abuttment is achieved, cursor 68 has left track 118, and has thus broken electrical contact between the batteries 10 and the light bulb 12. As mentioned earlier, the combined terminal land and incline 126 facilitates a smooth dismounting and remounting of track 118 by cursor 68, so as to minimize wear on the switch.

Figure 6:
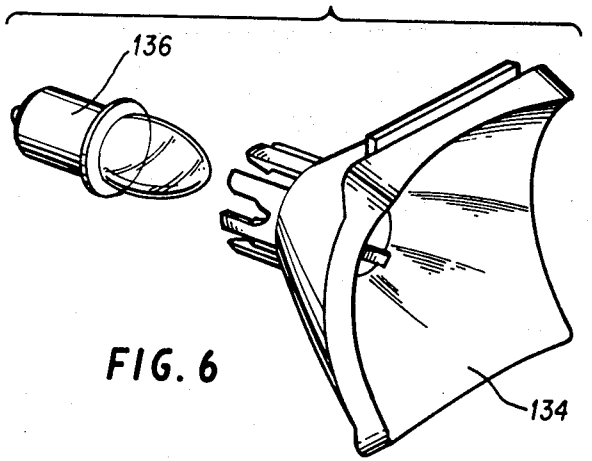
FIG. 6 is perspective view illustrating an alternate light bulb reflector useful in the present invention.

Referring now to FIG. 1, the operation of flashlight 2 is made similar to that of a cigarette lighter, by the provision of a plurality of serrations or grooves 132 adjacent pivot axis 8. Thus, a user wishing to manipulate head portion 6 may do so by thumb pressure and upward or downward motion against the serration 132, and head portion 6 will easily move in the desired direction. An alternate embodiment of the invention is illustrated in FIG. 6, wherein an alternate reflector construction is shown. In particular, full reflector housing 134 is utilized in the instance where the flashlight 2 is made to a size and scale larger than that of the standard pocket flashlight. Thus, in the instance where one wishes to make a flashlight of conventional size, a larger reflector such as that shown in FIG. 6 would be desirable. The reflector of this alternate embodiment would likewise provide a housing for the retention of an appropriate bulb such as bulb 136 shown herein. Apart from this modification, however, the remainder of the construction of flashlight 2 would be retained as described earlier herein, and both construction and operation would remain the same.

The flashlight of the present invention may be prepared from a variety of available commercial material, and is preferably prepared from commercially available plastics materials, as many of the parts thereof may be easily and inexpensively molded by well known plastics forming techniques, such as injection molding, stamping and the like. A variety of plastics materials are contemplated, including both natural and synthetic resins, synthetic resins further including polyolefins, polycarbonates, vinyl polymers, acrylic polymers, polyurethanes, and others. In particular, certain polymers identified as acetals are useful herein and are preferred, as they confer the desired durability, mechanical properties and resilience that insures extended useful life of the product.

It is understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within the spirit and scope and defined by the claims.

What is claimed is:

1. A flashlight comprising:

a. a body portion;

b. a head portion attached to said body portion and pivotal through a pivot arc about a single pivot axis, said pivot arc lying in the longitudinal plane of said body portion;

c. at least one battery in said body portion, and a light bulb in said head portion;

d. separate electrical contact means respectively located in said body portion and said head portion, and slidably engagable with each other;

e. electrical switch means defined by the said cooperation of separate electrical contact means, to control the flow of electrical current there-between, said switch means located inboard of said head portion and adjacent said pivot axis;

f. wherein said flashlight is switched off when said head portion is positioned in abuttment with said body portion, and is switched on in any of a plurality of positions when said head portion is partially or completely pivotted away therefrom.

2. The flashlight of claim 1 wherein said head portion is adjustable to a plurality of positions along its pivot arc, to permit adjustment in the direction of the beam of light emitted by said light bulb.

3. The flashlight of claim 1 wherein said pivot axis comprises paired, snap-fittably engagable axle stubs.

4. The flashlight of claim 2 further including incremental adjustment means communicating with said pivot axis to enable said head portion to reside in the plurality of positions along its pivot arc.

5. The flashlight of claim 4 wherein said adjustment means comprises:

a. at least one radially projecting resilient cleat, defined by at least one axle stub; and b. a plurality of regularly spaced, radially extending grooves located on said head portion adjacent said pivot axis and in such location as to be capable of individually receiving said cleat as said head portion is pivotted in relation to said body portion.

6. The flashlight of claim 1 further including a lens removably mounted in said head portion.

7. The flashlight of claim 6 wherein said lens is generally convexly shaped.

8. The flashlight of claim 7 wherein said body portion defines a concavity along a portion thereof adapted to nestingly receive said lens when said head portion is in abuttment with said body portion.

9. The flashlight of claim 1 wherein said body portion comprises:

a. a central frame;

b. at least one battery cradle defined by said frame; and c. paired, bilateral cover members removably attachable to said frame, at least one of said cover members cooperating with said cradle to enclose said flashlight battery.

10. The flashlight of claim 9 wherein two batteries are used and paired battery cradles are located in parallel position within the perimeter of said frame.

11. The flashlight of claim 9 wherein said frame includes parallel spines extending along at least the longitudinal portions of its perimeter, said spines cooperating with said cover means to define a plurality of disengagable latch means for the snap-fittable securement of said cover members to said frame.

* * * * *